US005526543A

United States Patent [19]

DiMatteo

[11] Patent Number: 5,526,543

[45] Date of Patent: Jun. 18, 1996

[54] METHOD AND APPARATUS FOR TREATING OR PREVENTING BED SORES

[75] Inventor: Paul DiMatteo, Dix Hills, N.Y.

[73] Assignee: Nova Technologies, Inc., Hauppauge, N.Y.

[21] Appl. No.: 175,441

[22] Filed: Dec. 30, 1993

Related U.S. Application Data

[63] Continuation-in-part of Ser. No. 908,988, Jul. 6, 1992, Pat. No. 5,319,813.

[51] Int. Cl.[6] ..... A61G 7/00

[52] U.S. Cl. ..... 5/464; 5/81.1 C; 5/615; 5/935; 5/937; 5/660

[58] Field of Search ..... 5/615, 81.1, 464, 5/465, 660, 935, 937, 453, 455, 903, 915

[56] References Cited

U.S. PATENT DOCUMENTS

| | | | |
|---|---|---|---|
| 1,772,310 | 8/1930 | Hart | 5/615 X |
| 2,559,956 | 7/1951 | Hay et al. | 5/91 |
| 3,221,349 | 12/1965 | Bradley | 5/317 |
| 3,739,409 | 6/1973 | Johnson | 5/345 |
| 3,775,781 | 12/1973 | Bruno et al. | 5/61 |
| 4,653,130 | 3/1987 | Senove et al. | 5/453 |
| 4,654,903 | 4/1987 | Chubb et al. | 5/61 |
| 4,751,918 | 6/1988 | Bernard et al. | 128/57 |
| 4,934,002 | 6/1990 | Watanabe | 5/61 |
| 4,941,220 | 7/1990 | DiMatteo et al. | 5/81.1 |
| 4,941,221 | 7/1990 | Kanzler | 5/903 X |
| 4,947,500 | 8/1990 | Seiler | 5/464 X |
| 4,977,629 | 12/1990 | Jones | 5/903 X |
| 5,092,007 | 3/1992 | Hasty | 5/453 |
| 5,121,512 | 6/1992 | Kaufmann | 5/903 X |
| 5,375,273 | 12/1994 | Bodine, Jr. et al. | 5/455 |

*Primary Examiner*—Michael F. Trettel

*Attorney, Agent, or Firm*—Patterson, Belknap, Webb & Tyler

[57] ABSTRACT

A method and apparatus for preventing or treating bed sores is disclosed which includes a mattress arrangement having a mattress and depressing means for depressing from underneath the mattress at least one area in the mattress to relieve pressure on at least one bed sore area of a patient. The depressing means includes at least one depression pad connected to a cable threaded through the mattress and attached to a pulling means. Further, a plurality of depression pads can be used to alternatively tilt the patient to relieve pressure from a bed sore area and may be used in conjunction with a mattress raising means to further tilt the patient. An optional conveyor sheet is provided for positioning the patient over the various depressed areas and/or for transferring the patient off the mattress to a wheelchair or other support area.

20 Claims, 8 Drawing Sheets

METHOD AND APPARATUS FOR TREATING OR PREVENTING BED SORES

This application is a continuation-in-part of U.S. Ser. No. 07/908,988 filed on Jul. 6, 1992, now U.S. Pat. No. 5,319, 813 and is hereby incorporated by reference.

BACKGROUND OF THE INVENTION

1. Field of the Invention

The present invention relates to a method and apparatus for preventing or treating bed-ridden patients from suffering from pressure ulcers (decubitus ulcers), commonly known as bed sores.

2. Description of the Related Art

Bed sores are a major concern to health care providers in acute care rehabilitation, nursing homes and home care facilities. Aside from the physical discomfort bed sores cause to the patient, complications from bed sores can arise including osteomyelitis and sepsis. Many patients suffering from bed sores or those at risk of developing bed sores are also unable to be easily and/or comfortably transferred between a bed and a wheelchair.

Preventing or treating bed sores associated with bed ridden patients has been dealt with in several references:

U.S. Pat. No. 3,221,349 to Bradley discloses a mattress depressor which can create a depression in a selected area of a mattress. The device consists of a lower arm underneath the mattress and an upper arm above the mattress. A depression is formed in the mattress by pressing down on the upper arm. Further, location of the depression area is chosen by moving the arms to a desired position.

U.S. Pat. No. 4,653,130 to Senoue et al. discloses a bed sore preventing apparatus comprising an air mattress with groups of air cells which, independent of each other, are pneumatically controlled.

U.S. Pat. No. 4,654,903 to Chubb et al. discloses a bed sore prevention device in an invalid bed arrangement. The bed may be tilted to shift the weight distribution of the patient from one side to the other side.

U.S. Pat. No. 4,751,918 discloses an anti-bed sore bed having a bed or mattress surface entirely covered with rows of small rollers for moving a patient to various positions on the mattress.

None of the above references solves the problem of easily and effectively controlling the discomfort associated with bed sores.

Accordingly, it is an object of the present invention to provide a method and apparatus for preventing or treating bed sores by easily and effectively relieving the pressure on a patient's body in specific local areas.

It is another object of the invention to provide a method and apparatus to easily position the patient on a mattress for the prevention or treatment of bed sores and to allow for the transfer of the patient to a wheelchair or other surface.

It is another object of the invention to provide a method and apparatus for tilting a patient from one side to the other side, or from a back position toward a side position in order to selectively reduce pressure on areas of the body and thereby improving blood circulation which aids in the prevention and treatment of bed sores.

SUMMARY OF THE INVENTION

A method and apparatus for preventing or treating bed sores is provided that includes a mattress with depressible areas, and preferably for easier positioning of the patient, an optional conveyor sheet. Preferably, several depressible areas, or groups of depressible areas, are used to depress a predetermined area on the mattress surface for either relieving pressure on certain areas of the body or to tilt the body to one side to relieve the pressures asserted on the other side.

The depressions are created by depression pads of varying size, each actuated by a cable system that connects the pad to a shaft which is either operated by hand or by a gear motor means. Directional changes of the cable along its path through and under the mattress is accomplished by pulley means.

In one preferred embodiment, the depression pads are positioned underneath a bed sore area of a patient. The pads are then used to depress the mattress and relieve pressure from the bed sore area. The preferred optional conveyor sheet can be used to easily position the patient over the depressed area.

In another preferred embodiment, depressible areas are arranged so that the mattress can be depressed to form a valley along one side or the other side in order to tilt a patient to one side or the other. Periodic tilting or turning shifts the pressure between body areas, increases the blood flow and stimulates circulation, thereby helping to prevent bed sores.

In another preferred embodiment, means are provided for tilting the patient by creating a depression on either side of the mattress while elevating the other side of the mattress. To accomplish this, the mattress is supported on two base plates, hinged along the longitudinal center of the mattress to a support platform. The lifting of either side is accomplished by inflating an air bag located under that side between the base plate and the support platform. After a time interval, the inflated air bag may be deflated, while the air bag of the other side may be inflated, to reverse the position of the patient.

These and other features of the present invention will become more readily apparent to those having ordinary skill in the art from the following detailed description of the invention taken in conjunction with the drawings.

BRIEF DESCRIPTION OF THE DRAWINGS

So that one skilled in the art to which the present invention appertains will better understand how to make and use the invention, preferred embodiments of the method and apparatus will be described below with references to the drawings, wherein.

DESCRIPTION OF PREFERRED EMBODIMENTS

Figure 1:
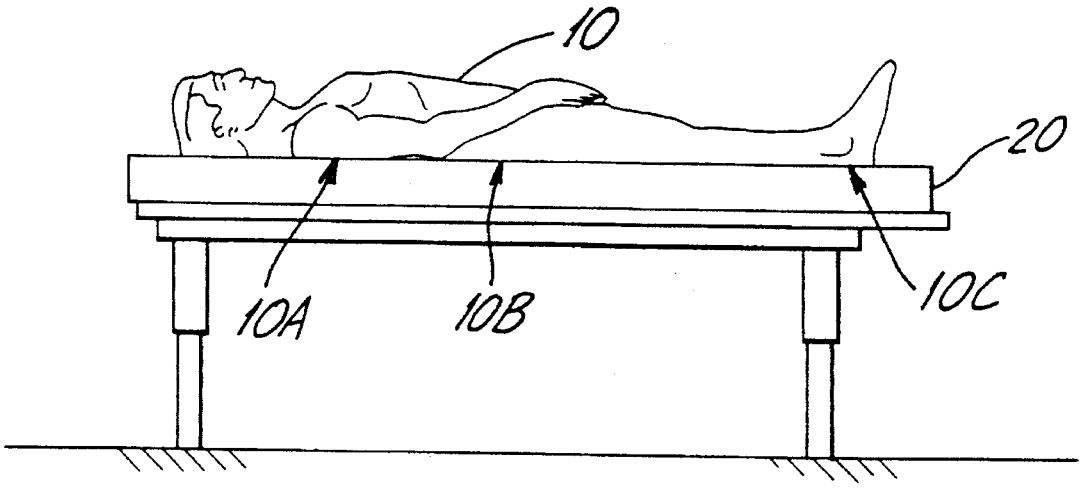
FIG. 1 is a depiction of a patient lying on a conventional bed mattress, pointing out the three typical pressure points.

Referring now to the drawings wherein like reference numerals indicate similar structural elements, there is illustrated in FIG. 1 a patient 10 lying on a conventional mattress 20. Three typical pressure points are illustrated on which bed sore areas typically occur: the area of the shoulder blades 10A, the area of the lower spine 10B, and the area of the heels 10C. Because prolonged pressure on these areas causes a decrease in blood flow, bed sores or pressure ulcers develop frequently.

Figure 2:
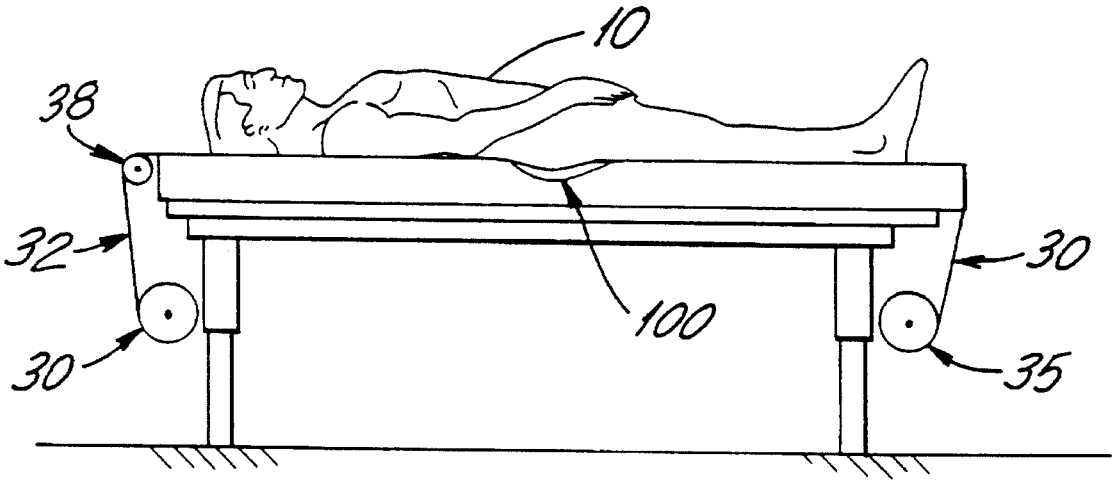
FIG. 2 is a depiction of a patient lying on a mattress system with a depression area created by a depression pad of the present invention.
Figure 5:
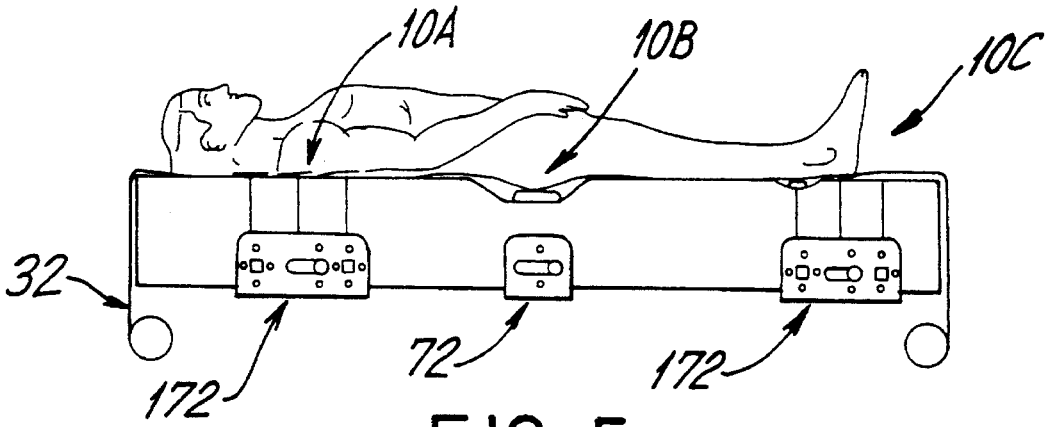
FIG. 5 is a side view of the mattress with several depressions created by a singular depression pad or groups of pads.

FIG. 2 shows a patient 10 lying on a mattress 21 having a depression 100 in the general area of the lower spine created by a depression pad according to the present invention. The patient may be positioned more precisely above the depression with an optional conveyor sheet 32. A bed employing a conveyor sheet arrangement such as that which is utilized in the present invention, is described, for example, in commonly assigned U.S. Pat. No. 4,819,238 to DiMatteo et al., the disclosure of which is incorporated by reference. In general, as illustrated in FIGS. 2 and 5, conveyor sheet 32 is operatively associated with a pair of transport rollers 30 and 35 and an idler roller 38. Transport rollers 30 or 35 may be driven by an electric motor or a hand crank to wind conveyor sheet 32 about one roller while unwinding conveyor sheet 32 from the other roller. The conveyor sheet may also be used for moving the patient entirely off the mattress and onto a transfer wheelchair or other surface, not shown, located at the foot end of the bed. Other arrangements for moving conveyor sheet 32 relative to the mattress to transport a patient across the bed are also known to those skilled in the art and are within the scope of the subject invention.

Figure 3A:
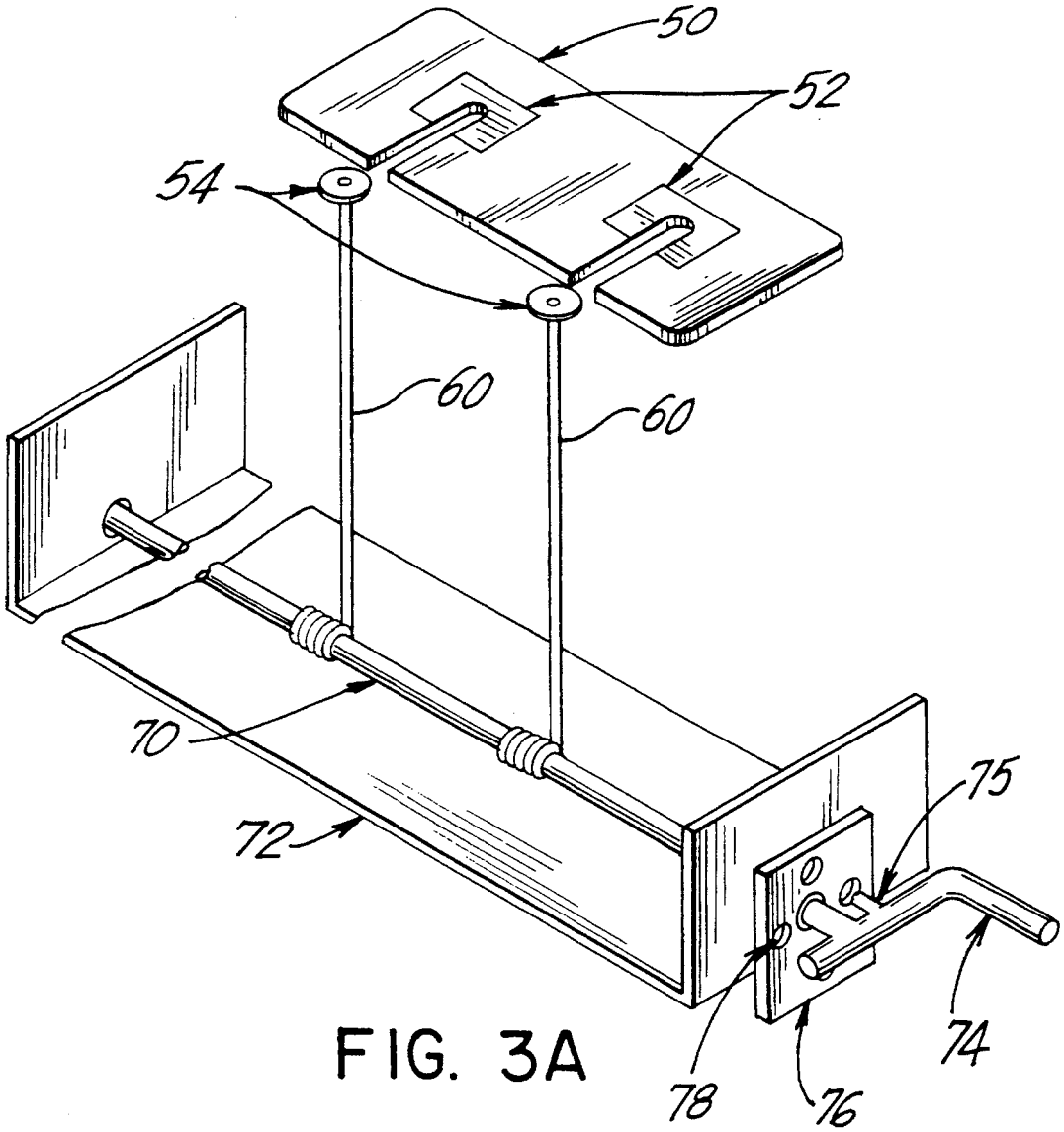
FIG. 3A is an isometric view of a depression pad assembly without the mattress.
Figure 3B:
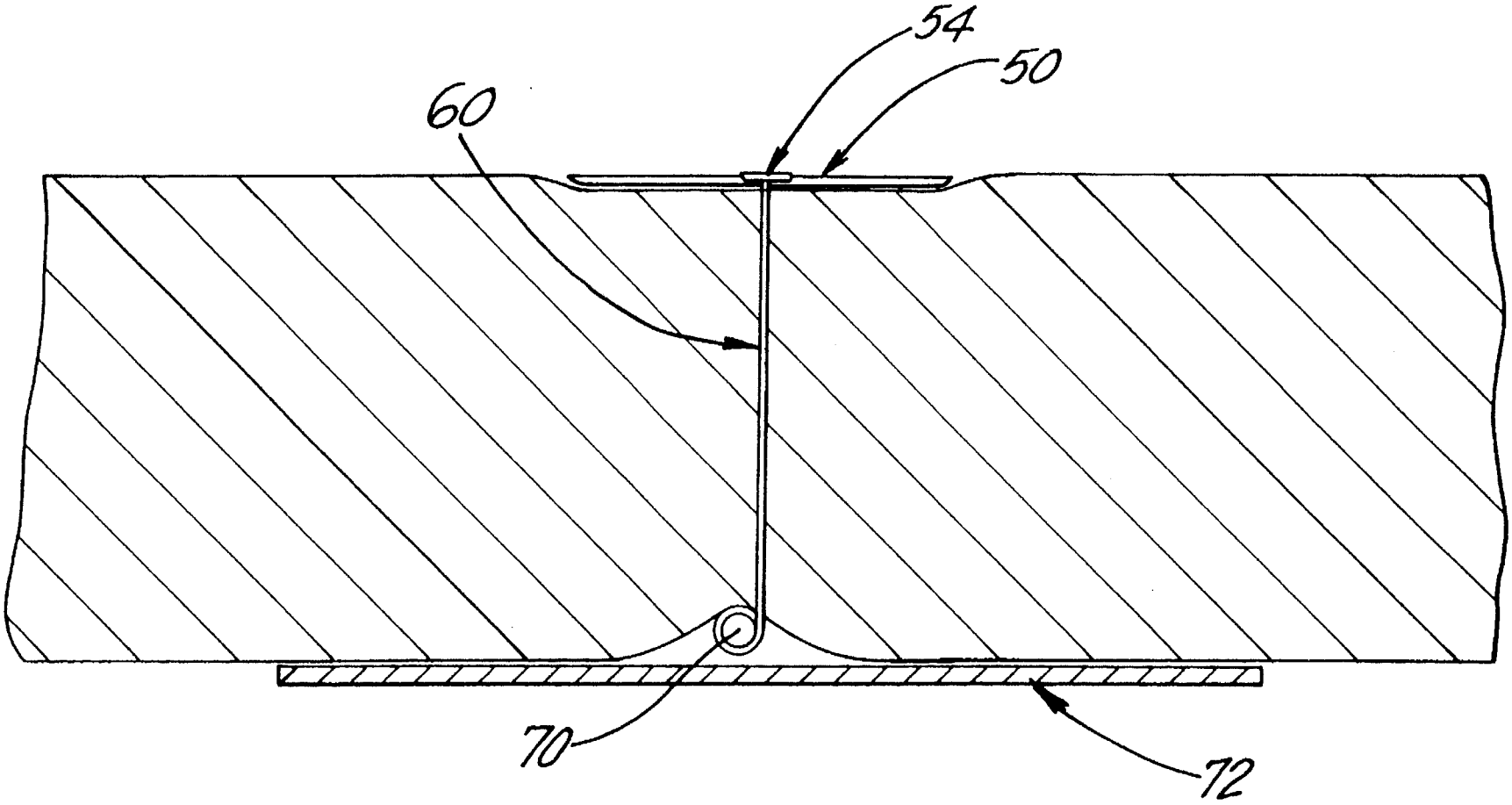
FIG. 3B is a partial cross-sectional side view of a depression pad assembly with the mattress.

Referring to FIGS. 3A and 3B, there is shown a depression pad assembly, with and without the mattress, respectively. The slotted mattress depression pad 50 is placed on the surface of the mattress. The pad 50 is moved below the washers 54 located at one end of the cables 60 and may be held in place by touch-to-close, pull-to-release material 52, for example VELCRO®, on the top side of depression pad 50 and on the underside of the washers 54. This makes the depression pad easy to remove and to replace by another depression pad of a different shape and size to meet the needs of different patients. Further, as will become apparent to those skilled in the art, padding for cushioning the patient from the depression pad 50 can be placed on top of the depression pad 50 using VELCRO® or other similar materials.

In FIG. 3B, it is schematically shown how the cables 60 extend from the top through the mattress to the bottom side of the mattress. Located below the mattress is a shaft 70. The other ends of the cables 60 are attached to the shaft 70 so that they may be wound about the shaft 70 for pulling down the pad or for releasing the pad.

As seen in FIG. 3A, the shaft 70 is held in place on a backing plate 72 with bushings inserted at either end and a compression springs held by a clip. The backing plate 72 has a surface area large enough to assure that virtually all of the mattress depression occurs on the top surface of the mattress and not on the bottom side. At least one vertical side of the backing plate 72 is aligned with one side of the mattress. The shaft 70 is adapted to hold a crank handle 74 for rotating the shaft 70 clockwise or counter-clockwise. By rotating the shaft 70, the tension of the cables 60 change to either cause pulling or releasing the depression pads 50 in the mattress. The crank handle 74 is removable to avoid protrusion from the side of the mattress when a mattress cover is slipped over the mattress. A peg 75 is an integral part of the crank handle which may engage into a choice of holes 78 arranged on a radius extending from the shaft axis on a plate 76 attached to the side of the backing plate 72. The engagement of the peg 75 into one of the holes prevents the shaft from further turning. Alternatively, as will become readily apparent to those skilled in the art, the process of pulling down on the cable 60 can be automated by rotating the shaft 70 with an electronic gear motor or the like or otherwise pulling down on cables 60.

Figure 4:
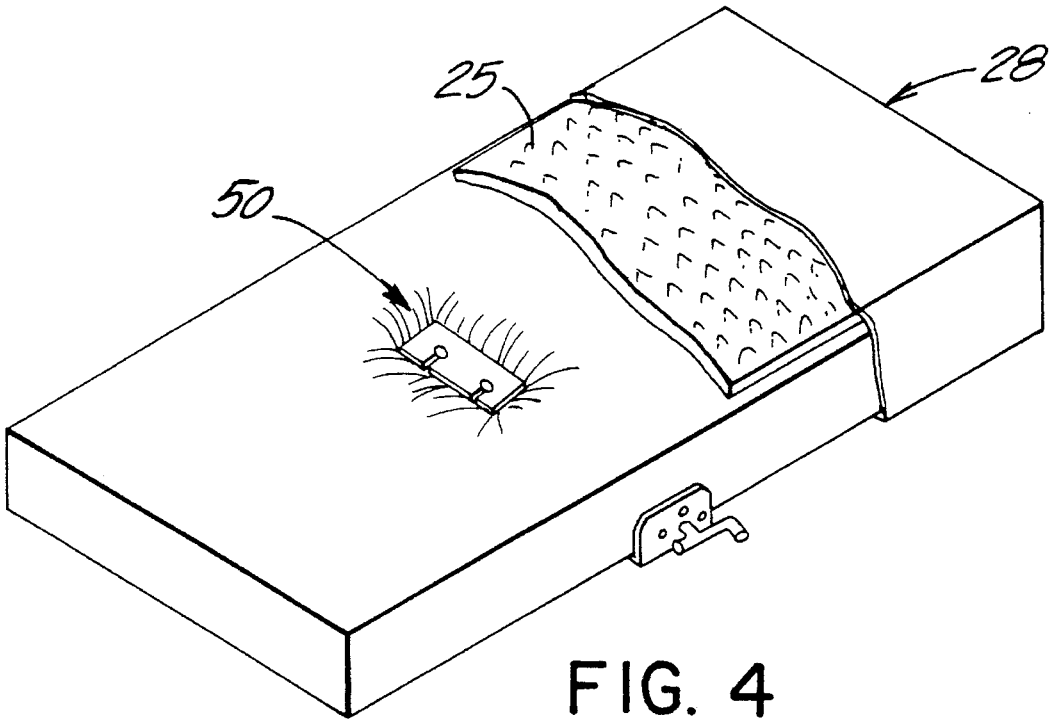
FIG. 4 is a partially cut-away isometric view of a mattress with a depression area created by one depression pad.

FIG. 4 shows a partial cutaway view of the mattress with a depression pad 50. A soft material pad or a foam pad, for example a so-called egg crate pad 25, covers the depressed mattress to assure a continuous surface with smoothened, soft-edged depression areas. A mattress protection bag 28 covers the entire mattress to keep liquids and moisture from the mattress. At least one flap, not shown, in the side of the mattress protection bag provides access for the crank handle or handles. In the event the assembly shown in FIG. 3A is mounted outside of mattress protection bag 28, holes can be provided for cables 60 through the bottom of mattress protection bag 28 and through mattress 20.

A mattress with several depression pads is shown in FIG. 5. This mattress may be utilized when caring for a patient suffering from several bed sores. Depression pads for this embodiment are installed in the mattress where one would expect an average sized person to rest the shoulder blades 10A, the base of the spine 10B, and the heels 10C. If the depression areas from such pads do not match the areas of the body where the bed sores are, for example, for a particularly tall or short patient, a conveyor sheet 32 may be used to move the patient at intervals, between positions where such points line up with depression area. Because the patient is stationary with respect to the conveyor sheet, moving the patient with the sheet does not cause shear stress, and thus, does not aggravate the bed sores. In fact, the motion may be helpful in promoting blood flow.

FIG. 5 also shows the use of groups of depression pads to make up one depression area. The shoulders 10A are positioned on depression areas made up of three depression plates 172, the lower spine rests above a depression area created by one depression pad 72, and the heels rest above a depression area created by three depression plates 172.

Figure 6A:
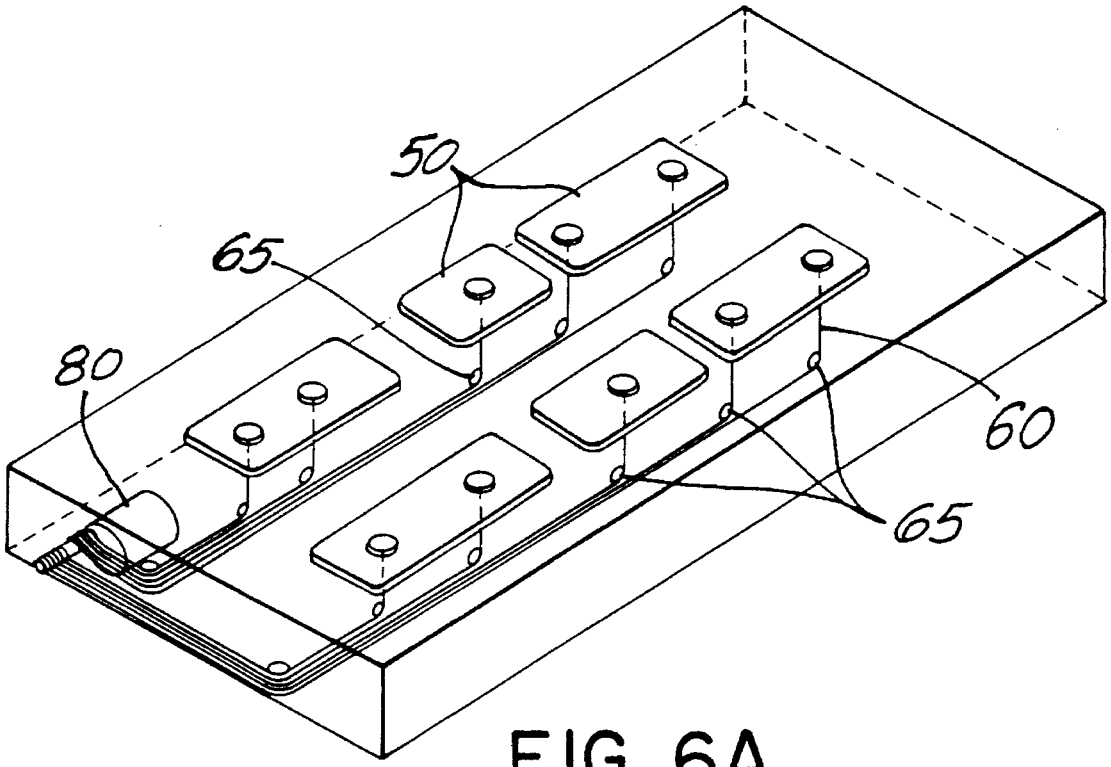
FIG. 6A illustrates an arrangement for tilting or turning a patient from side to side.

FIG. 6A illustrates another use for depression areas. For relieving pressure on areas of the body, it is recommended to turn the patient from side to side. For example, the mattress depression pads 50 are arranged in two rows on the mattress corresponding to the patient's left and right sides, from the shoulder area down to the foot area. Depression pads 50 are connected to their associated cables 60 which are guided over pulleys 65 to a reversible gear motor 80 having a friction brake. The pulleys 65 are mounted on a bottom plate, not shown, which extends under the bottom of the mattress. As will become apparent to those skilled in the art, the depression pads or the patient or both can be positioned so as to allow for tilting only portions of the patient's body while allowing the patient's head to remain untilted.

Figure 6B:
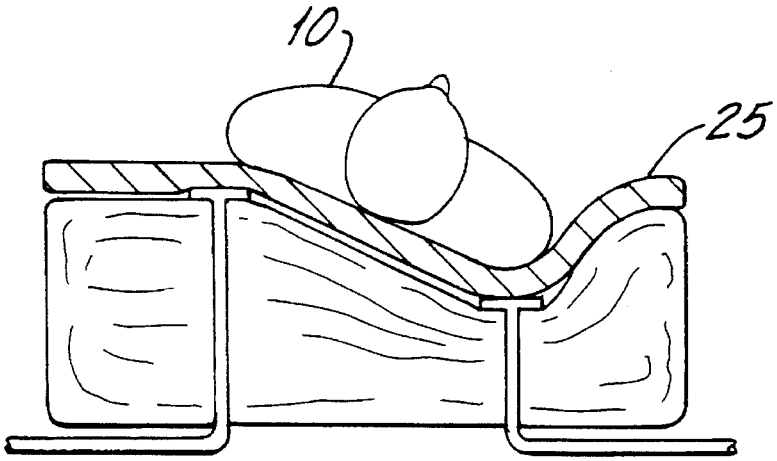
FIG. 6B is an end view showing a patient tilted to one side.

FIG. 6B shows how a patient 10 can be tilted and comfortably supported by the arrangement of FIG. 6A, including a foam pad 25 under the patient.

Figure 7:
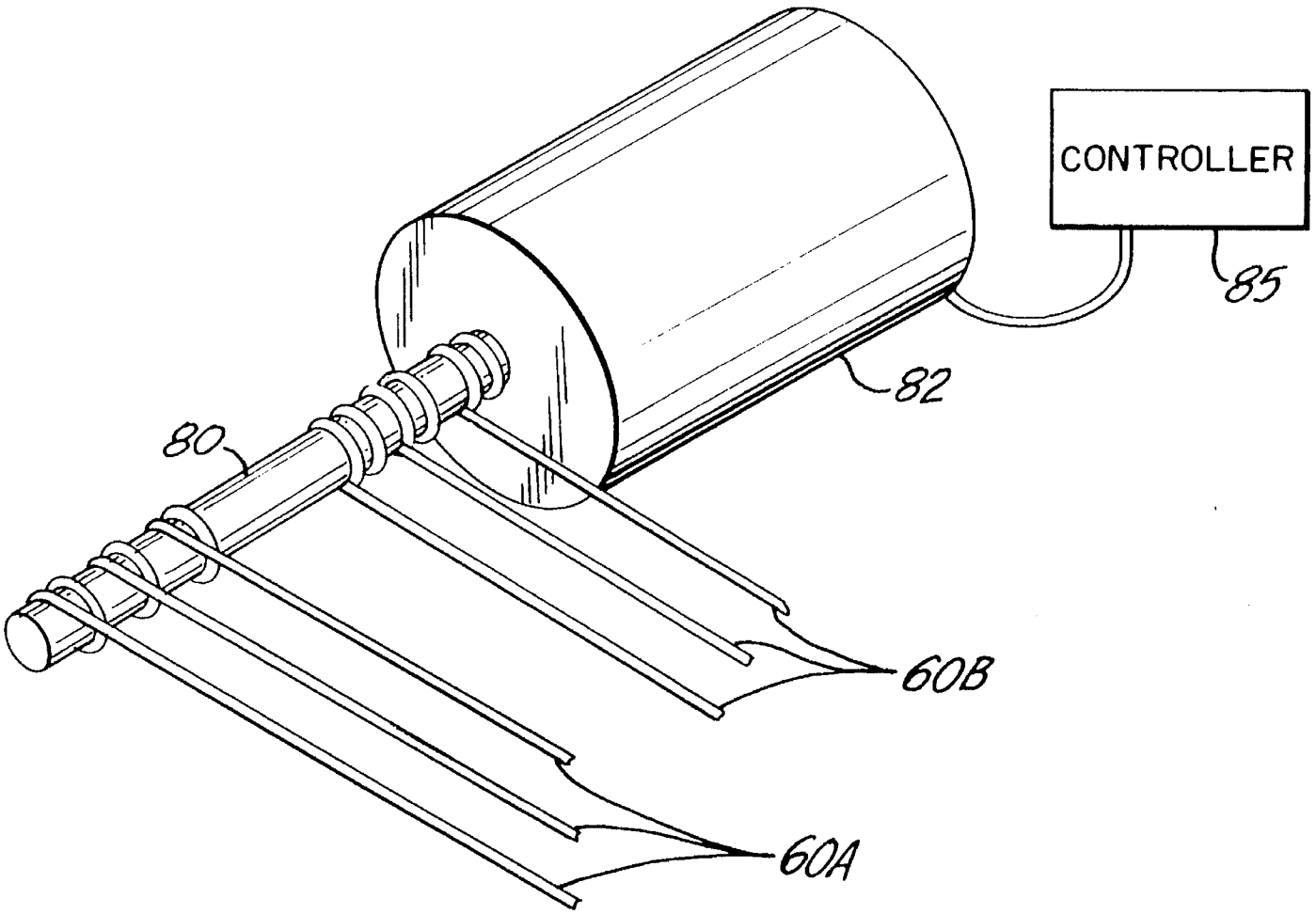
FIG. 7 is a view of the attachment of the cable ends to a motor shaft, subject to being wound up on the shaft or released from the shaft.

FIG. 7 shows the gear motor 82 with a motor shaft 80. The cables 60A from the depression pads on one side of the mattress are wound clockwise around the motor shaft, while cables 60B from the other side of the mattress are wound around the motor shaft counter-clockwise. When both sets of cables are slack, neither group of depression pads create depressions and, thus, neither side of the mattress is depressed. Rotating the motor in one direction pulls down one row of the depression pads and releasing any tension of the other row; and rotating the motor in the other direction pulls down the other row of depression pads, and releases the first row.

The gear motor, controlled by a suitable controller 85, can run the motor at predetermined intervals, for example, first clockwise to depress one side of the mattress a predetermined amount and then, after a suitable time interval, counter-clockwise until the other side of the mattress is depressed by a predetermined amount. In order to control the amount of mattress depression, a stepper, or a servo motor with feed back from an output position sensor, may be used. Both the time intervals and the mattress depression depth may be programmed in the controller to meet the special needs of individual patients.

Figure 8:
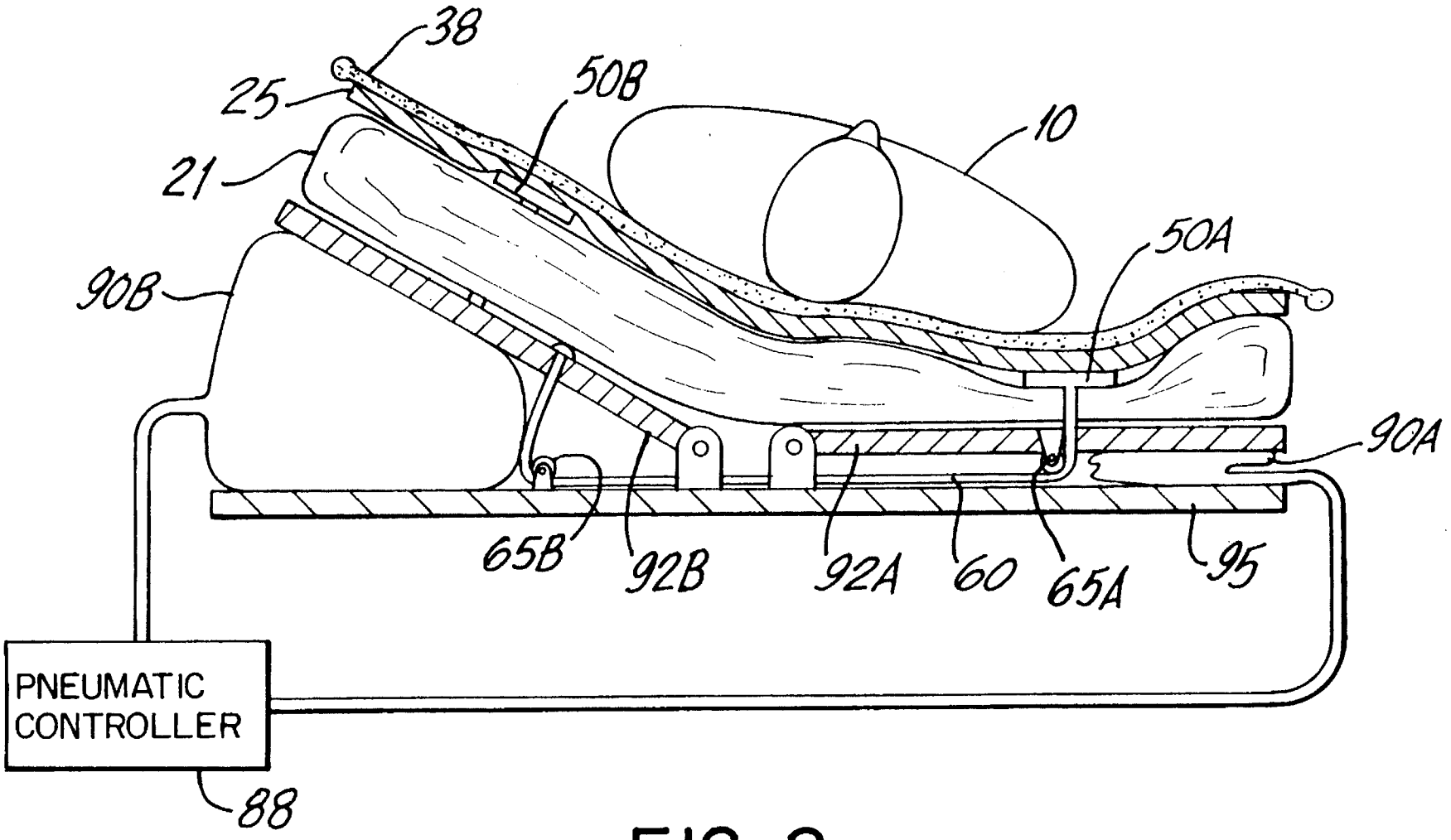
FIG. 8 is a cross-sectional partial view of the mattress with depression pads showing a tilting arrangement using inflatable bags.

Turning now to FIG. 8, there is illustrated another method and apparatus for tilting or turning a patient from side to side in accordance with the present invention. The mattress 21 which includes a mattress cover (not shown) is supported by two movable base plates 92A and 92B hinged near the longitudinal center to a support platform 95. Each base plate may be lifted to raise a portion of the mattress to elevate one side of the patient to tilt or turn him. The lifting may be accomplished with inflatable wedge-shaped air bags 90A and 90B located between the base plates and the support platform.

While the patient 10 is lying on the mattress 21, either air bag 90A or 90B may be inflated, thus, raising one of the two movable base plates and thereby lifting the patient on one side. Depression pads 50A which are also incorporated in this embodiment are positioned along the top of the mattress 21 on the right side and are connected by cables 60 which are guided by the pulleys 65A and 65B to the hinged base plate 92B. Raising the base plate 92B pulls the cable 60 which pulls down the depression pads 50A, making a depression along the right side of the mattress 21. By so raising the left side of the mattress and depressing the right side, the patient 10 is turned to the right. For turning the patient to the left, depression pads 50B along the left side of the mattress are connected similarly to the right baseplate 92A by cables, not shown for reasons of clarity. To turn the person to the left, the air bag 90A is inflated and the air bag 90B is deflated. Under the patient 10 is an optional movable sheet 38 for positioning the patient longitudinally and a page 25 for comfort.

The arrangement in FIG. 8 provides greater patient tilt than the depression pads alone.

A pneumatic controller 88 inflates and deflates the airbags 90A and 90B to provide the desired patient tilting program.

Other combinations of air bags and depression pads may be provided as may be needed for tilting and positioning individual patients.

Figure 9:
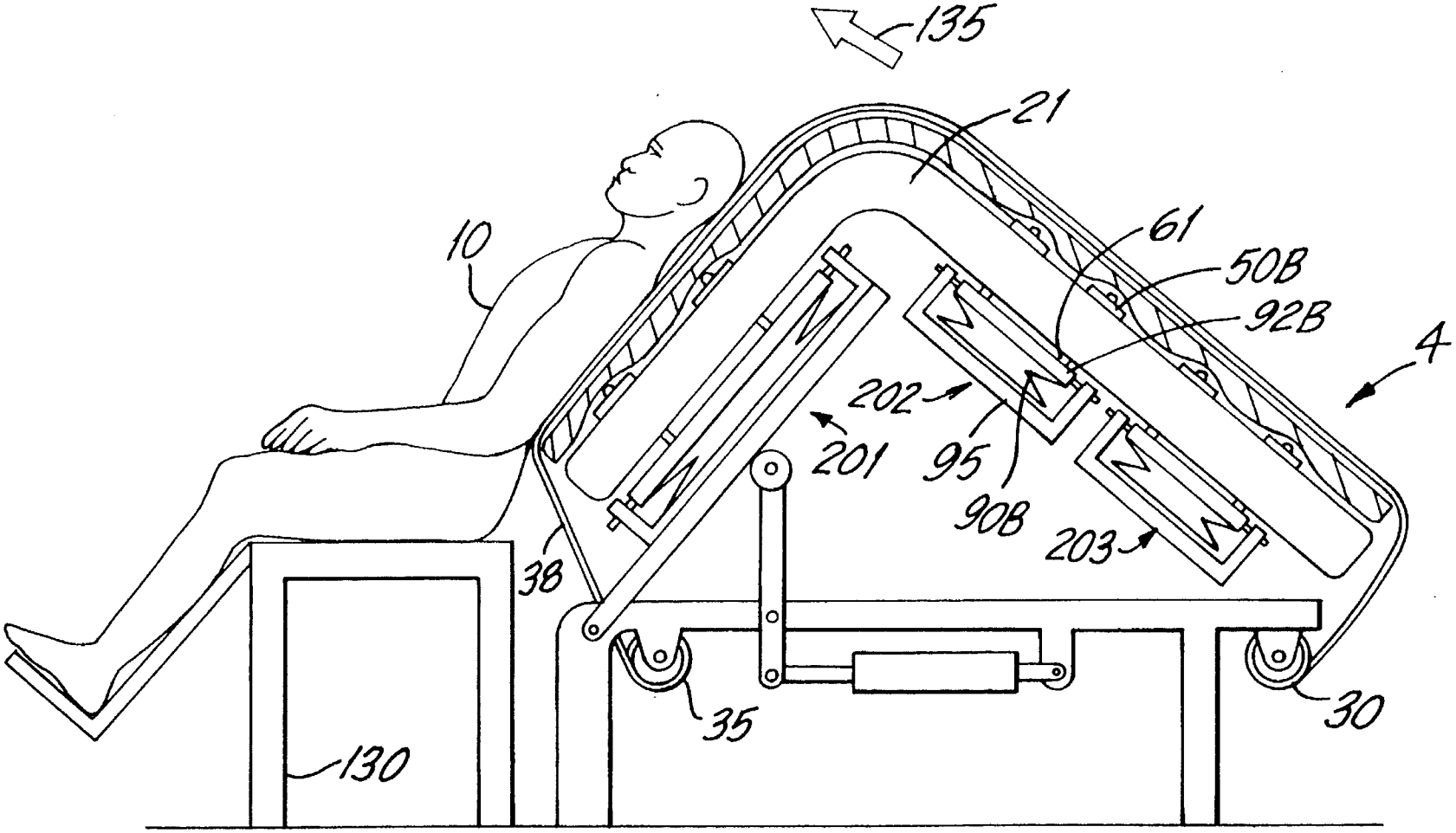
FIG. 9 is a side view of a mattress and bed equipped with the tilting arrangement shown in FIG. 8 and with the mattress equipped with a moving sheet and being raised for transferring a patient from the bed to a wheelchair.

FIG. 9 is a side view of a bed 4 and a mattress 21 equipped with three tilting modules 201, 202 and 203, each similar to the arrangement shown in FIG. 8, including a support platform 95, two movable base plates 90B and 90A (not visible) and air bags 90B and 90A (not visible). FIG. 9 shows that when all the air bags, 90A and 90B are deflated so that the mattress 21 is not tilted, the mattress can be raised, and the tilt modules remain held to the mattress by the cables 60 connected to the depression plates 50B. As a result, the patient 10 can be transported partially onto a chair 130 at the end of the bed by winding the sheet 38 onto roller 35 and unwinding the sheet from the roller 30. The mattress 21 can then be used to lift the patient to a sitting position on the chair. The chair may be a wheelchair securely positioned at an end of the bed.

Although the prevention or treatment of bed sores of the subject invention has been described with respect to a number of preferred embodiments, it will be readily apparent to those having ordinary skill in the art to which the invention appertains that changes and modifications may be made thereto without departing from the spirit or scope of the subject invention as defined by the appended claims.

What is claimed:

1. A method for preventing or treating bed sore areas of a person lying on a mattress, wherein bed sore areas include areas which have bed sores, areas which are at risk of developing bed sores, or both, comprising the steps of:

a) pulling on a member from underneath the mattress to create a depression in the mattress; and b) positioning at least one bed sore area over the depressed area of the mattress to relieve pressure on the at least one bed sore area.

2. A method according to claim 1 wherein the positioning step is accomplished by using a conveyor sheet.

3. A method according to claim 1 wherein the depression is created by pulling down on a depression pad.

4. A method as according to claim 3 wherein the depression pad is pulled down by the following steps:

a) attaching the depression pad to at least one cable;

b) pulling the at least one cable from underneath the mattress.

5. A method for preventing or treating bed sore areas of a person lying on a mattress having a surface, wherein bed sore areas include areas which have bed sores, areas which are at risk of developing bed sores, or both, comprising the steps of:

a) raising one side of the mattress to deform the mattress surface to tilt the person to the other side of the mattress to relieve pressure from at least one bed sore area; and b) depressing the other side of the mattress to deform the mattress surface to further tilt the person.

6. A method according to claim 5 further comprising the step of untilting the person after a selected period of time to relieve pressure caused by tilting.

7. A method according to claim 6 further comprising the step of tilting the person to the other side on the mattress to relieve pressure from the at least one bed sore area.

8. A method according to claim 5 wherein the mattress raising step and mattress depressing step are performed simultaneously.

9. A method according to claim 8 wherein the mattress depressing step includes the step of pulling down on at least one depression pad.

10. A method according to claim 9 wherein the mattress raising step is performed by inflating an air bag underneath the mattress.

11. A mattress arrangement for preventing or treating bed sore areas of a person lying on a mattress, wherein bed sore areas include areas which have bed sores, areas which are at risk of developing bed sores, or both, comprising:

a) a mattress;

b) depressing means for depressing from underneath the mattress at least one area in the mattress to relieve pressure on at least one bed sore area.

12. A mattress arrangement according to claim 11 where the depressing means includes at least one depression pad.

13. A mattress arrangement according to claim 12 wherein the at least one depression pad is connected to at least one cable.

14. A mattress arrangement according to claim 13 wherein the at least one cable is threaded through the mattress and attached to a pulling means for pulling the at least one cable and the at least one depression pad.

15. A mattress arrangement according to claim 14 wherein the pulling means includes a shaft for winding and pulling the at least one cable.

16. A mattress arrangement according to claim 14 wherein the amount of depression is set by controlling the pulling means.

17. A mattress arrangement according to claim 11 wherein the depressing means can create a depression sufficient to tilt the person to one side of the mattress so as to relieve pressure from the at least one bed sore area.

18. A mattress arrangement according to claim 17 further comprising a mattress raising means to help tilt the person to relieve pressure from the at least one bed sore area.

19. A mattress arrangement according to claim 18 further comprising a control means for periodically causing the depressing means and raising means to tilt and untilt the person.

20. A mattress arrangement for treating or preventing bed sore areas on a person lying on a mattress and for transferring the person to a sitting position on a seat positioned at an end of the bed comprising:

a) a mattress;

b) means for depressing at least one area in the mattress from underneath the mattress to relieve pressure on at least one bed sore area;

c) a sheet extending over the mattress and means for moving the sheet to transport a person across the mattress and partially onto the seat; and d) means for raising the mattress to lift the person to a sitting position on the seat.

* * * * *